US010506887B2

(12) United States Patent
Bellar et al.

(10) Patent No.: US 10,506,887 B2
(45) Date of Patent: Dec. 17, 2019

(54) ITEM ALIGNMENT TOOL

(71) Applicant: Walmart Apollo, LLC, Bentonville, AR (US)

(72) Inventors: Jason Bellar, Bella Vista, AR (US); William Mark Propes, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/997,076

(22) Filed: Jun. 4, 2018

(65) Prior Publication Data

US 2019/0038050 A1 Feb. 7, 2019

Related U.S. Application Data

(60) Provisional application No. 62/540,239, filed on Aug. 2, 2017.

(51) Int. Cl.
*A47F 13/08* (2006.01)

(52) U.S. Cl.
CPC ..... *A47F 13/08* (2013.01)

(58) Field of Classification Search
CPC ..... B25J 1/04; A47F 13/06; A47F 13/08
See application file for complete search history.

(56) References Cited

U.S. PATENT DOCUMENTS 1,641,168 A * 9/1927 Jacques ..... B27B 21/08 33/429
2,439,568 A * 4/1948 Hall ..... B23Q 13/00 150/161
D383,961 S * 9/1997 Scales, III ..... D3/228
6,026,717 A * 2/2000 Anderson ..... B25B 23/12 81/125
6,434,838 B1 * 8/2002 Mai ..... B23Q 13/00 30/151
6,457,244 B1 * 10/2002 Huang ..... B23D 51/12 30/513
6,502,875 B1 1/2003 Berry
8,308,209 B1 * 11/2012 Bibow ..... B25G 3/22 294/175

(Continued)

OTHER PUBLICATIONS

Sears.com, "Milescraft FramingSquare500 (Imperial)", Jul. 13, 2016, https://www.sears.com/milescraft-framingsquare500-imperial/p-00905278000P# (Year: 2016).*

(Continued)

*Primary Examiner* — Stephen A Vu
(74) *Attorney, Agent, or Firm* — McCarter & English, LLP; David R. Burns

(57) ABSTRACT

Example item alignment tools for aligning items on a shelf are described. The item alignment tools include an elongated planar body defining a proximal end, a distal end, a bottom straight edge, a top edge, and first and second opposing sides extending between the bottom straight edge and the top edge. The item alignment tools include a handle coupled to the proximal end of the elongated planar body. The item alignment tools include a wrap positioned over and covering at least a portion of the bottom straight edge of the elongated planar body to provide a protective layer for sliding along a surface of a shelf to facilitate alignment of items on the shelf.

20 Claims, 8 Drawing Sheets

(56) References Cited

U.S. PATENT DOCUMENTS

| | | | | |
|---|---|---|---|---|
| 8,322,040 | B2 | 12/2012 | Jimenez | |
| 8,608,218 | B1 | 12/2013 | Marthens | |
| 9,510,697 | B2 | 12/2016 | Wagner | |
| 2003/0000092 | A1* | 1/2003 | Liu | B23D 49/10 30/519 |
| 2009/0261607 | A1 | 10/2009 | Braver | |
| 2012/0237330 | A1 | 9/2012 | Wensman | |
| 2016/0213172 | A1 | 7/2016 | Christoffersen | |

OTHER PUBLICATIONS

Amazon.com, Stanley 20-045 15-Inch Fat Max Hand Saw, <https://www.amazon.com/Stanley-20-045-15-Inch-Fat-Hand/dp/B00005A1JN>, last viewed Jun. 17, 2017.

* cited by examiner

ITEM ALIGNMENT TOOL

CROSS-REFERENCE TO RELATED APPLICATIONS

This application claims the benefit of commonly assigned U.S. Provisional Patent Application No. 62/540,239, which was filed on Aug. 2, 2017. The entire content of the foregoing provisional patent application is incorporated herein by reference.

BACKGROUND

Retail environments generally include a variety of items displayed on shelves. During zoning or facing of items, an associate generally touches each of the items to align them on the shelf. Such traditional process of zoning or facing items can therefore be inefficient and can result in variations in alignment of items with each other and the front of the shelf.

SUMMARY

Exemplary embodiments of the present disclosure provide an item alignment tool for aligning items on a shelf. The item alignment tool includes an elongated planar body with a handle, such that the elongated planar body can be passed between items positioned on the shelf. The elongated planar body can be urged laterally sideways using the handle to align multiple items at the same time. An associate can therefore align items on the shelf without having to reach between items and/or touching each of the items, resulting in an efficient zoning or facing process.

In accordance with embodiments of the present disclosure, an exemplary item alignment tool for aligning items on a shelf is provided. The item alignment tool includes an elongated planar body defining a proximal end, a distal end, a bottom straight edge, a top edge, and first and second opposing sides extending between the bottom straight edge and the top edge. The item alignment tool includes a handle coupled to the proximal end of the elongated planar body. The item alignment tool includes a wrap positioned over and covering at least a portion of the bottom straight edge of the elongated planar body to provide a protective layer for sliding along a surface of a shelf to facilitate alignment of items on the shelf.

The bottom straight edge can be uniformly flat between a point near the proximal end of the elongated planar body and a point near the distal end of the elongated planar body. The proximal end of the elongated planar body can include a cutout extending therethrough. The handle can include an opening extending therethrough. The opening of the handle can be substantially complementary to the cutout of the elongated planar body. In some embodiments, the handle can include a first handle half and a second handle half coupled on opposing sides of the elongated planar body.

In some embodiments, the handle can include a distal edge extending at an angle relative to the bottom edge of the elongated planar body. In some embodiments, the angle can be an acute angle. In some embodiments, the wrap can be a vinyl wrap, a silicone wrap, a dipped ceramic wrap, a high-density polyethylene wrap, or the like. The wrap can extend over at least a portion of the first and second opposing sides of the elongated planar body.

The elongated planar body can define a rigid structure having a sufficient rigidity for urging movement of multiple items on the shelf during alignment of the items. Particularly, the body (and tool itself) has sufficient rigidity to move items being straightened or aligned on the shelf without deflecting to a point that would impede the use of the tool (e.g., the tool is sufficiently rigid to maintain a substantially straight alignment of items during use of the tool). The bottom straight edge and the top edge of the elongated planar body can define planar or linear surfaces. In some embodiments, a distance between the bottom straight edge and the top edge can be substantially equal between a point near the proximal end of the elongated planar body and a point near the distal end of the elongated planar body.

In some embodiments, the item alignment tool can include a magnet incorporated into the handle. In some embodiments, the item alignment tool can include an illumination source incorporated into the handle. In some embodiments, the top edge of the elongated planar body can include graduations for distance measurement. In some embodiments, a label can be attached to at least one of the first or second side of the elongated planar body. In some embodiments, one or more corners at the distal end of the elongated planar body can be rounded or curved.

In accordance with embodiments of the present disclosure, an exemplary item alignment tool for aligning items on a shelf is provided. The item alignment tool includes an elongated planar body defining a proximal end, a distal end, a bottom straight edge, a top edge, and first and second opposing sides extending between the bottom straight edge and the top edge. The bottom straight edge and the top edge of the elongated planar body can define planar or linear surfaces. The item alignment tool includes a handle coupled to the proximal end of the elongated planar body. The item alignment tool includes a wrap positioned over and covering at least a portion of the bottom straight edge of the elongated planar body, and extending over at least a portion of the first and second opposing sides of the elongated planar body. The wrap can be fixedly attached to the portion of the bottom straight edge. The wrap provides a protective layer for sliding along a surface of a shelf to facilitate alignment of items on the shelf.

In accordance with embodiments of the present disclosure, an exemplary method of aligning items on a shelf having a supporting surface is provided. The method includes positioning an item alignment tool on the supporting surface of the shelf. The item alignment tool includes an elongated planar body defining a proximal end, a distal end, a bottom straight edge, a top edge, and first and second opposing sides extending between the bottom straight edge and the top edge. The item alignment tool includes a handle coupled to the proximal end of the elongated planar body. The item alignment tool includes a wrap positioned over and covering at least a portion of the bottom straight edge of the elongated planar body. The method includes extending the distal end of the elongated planar body between items on the supporting surface of the shelf. The method includes laterally sliding the elongated planar body along the supporting surface to urge the items towards a specific side of the shelf.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed item alignment tool, reference is made to the accompanying figures, wherein.

DETAILED DESCRIPTION

Figure 1:
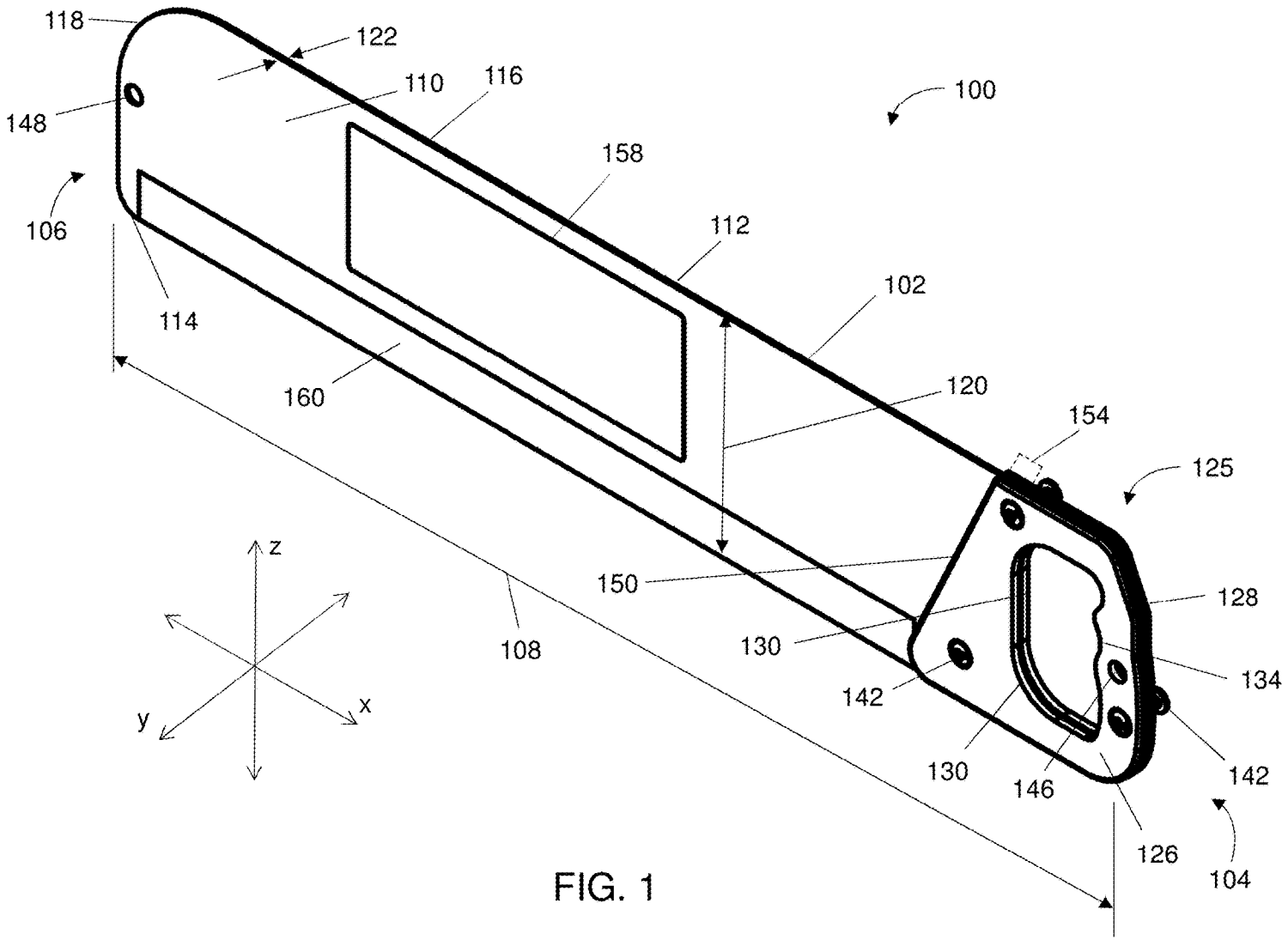
FIG. 1 is a perspective view of an exemplary item alignment tool of the present disclosure.

Exemplary embodiments of the present disclosure provide an item alignment tool that allows for efficient and accurate alignment of multiple items on a shelf surface. In particular, the item alignment tool includes a rigid, elongated planar body configured to be passed between items positioned on the shelf. Thus, rather than reaching between items with one's hand, the planar body can be passed between the items. The elongated planar body can be urged laterally sideways using the handle to align multiple items at the same time. Items can therefore be efficiently zoned or faced without disturbing surrounding items that have already been aligned or zoned.

FIGS. 1-4 are perspective, exploded, side and top views of an exemplary item alignment tool 100 (hereinafter "tool 100"). The tool 100 generally includes an elongated body 102 extending between the proximal and distal ends 104, 106 of the tool 100. The body 102 generally defines planar or flat and parallel side walls 110, 112 extending the length 108 of the body 102. In some embodiments, the body 102 can be formed from a sheet of rigid material (e.g., a sheet of metal, or the like). In some embodiments, one or more labels 158 can be adhered to the side walls 110, 112 to provide information to the user. The body 102 includes a bottom substantially straight edge 114 and a top substantially straight edge 116 with the opposing side walls 110, 112 extending between the top and bottom edges 114, 116.

The bottom edge 114 and the top edge 116 can extend between points at or near the proximal and distal ends 104, 106 in a substantially planar, linear or parallel manner. In some embodiments, the top edge 116 can be at an angle relative to the bottom edge 114. The bottom edge 114 can be uniformly flat between points at or near the proximal and distal ends 104, 106. The uniformly flat bottom edge 114 can be placed against a surface of a shelf, thereby aligning the bottom of the tool 100 with the shelf surface. In some embodiments, one or more corners of the body 102 can be curved or rounded. For example, the upper corner 118 of the distal end 106 of the body 102 can be curved or rounded. Such curvature can assist in guiding the distal end 106 of the tool 100 between items disposed on the shelf.

The distance or height 120 of the body 102, measured between the bottom and top edges 114, 116, respectively, can be dimensioned shorter than the length 108 of the body 102, measured between the proximal and distal ends 104, 106, respectively. The width 122 of the body 102, measured between the parallel side walls 110, 112, can be significantly smaller than the length 108 and height 120 (e.g., a fraction of the length 108 or height 120). For example, the length 108 can be approximately 24.5 inches, the height can be approximately 5 inches, and the width 122 can be approximately 0.07 inches. In some embodiments, the height 120 can be substantially equal between points near the proximal and distal ends 104, 106.

Figure 2:
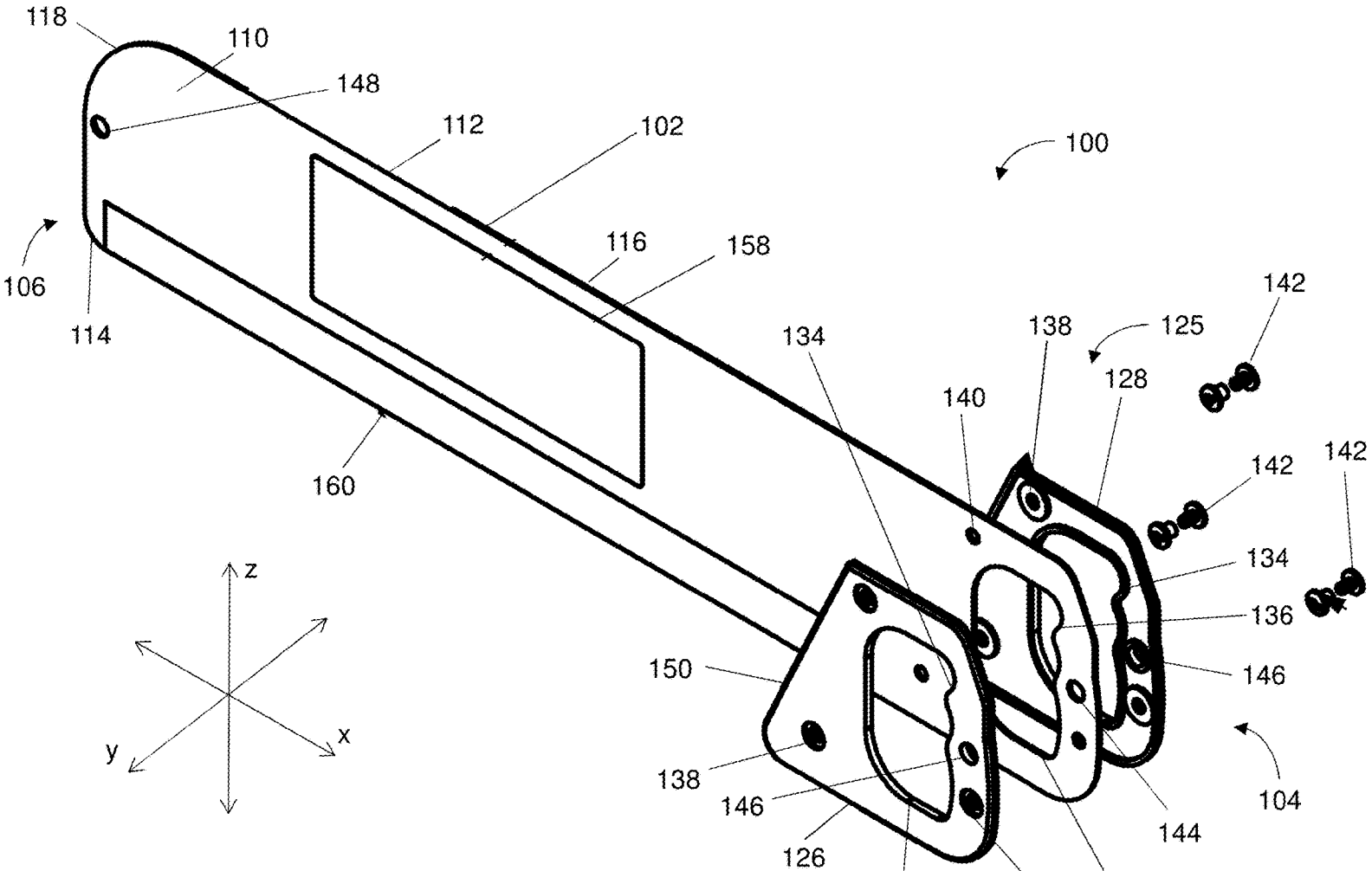
FIG. 2 is a perspective, exploded view of an exemplary item alignment tool of the present disclosure.
Figure 3:
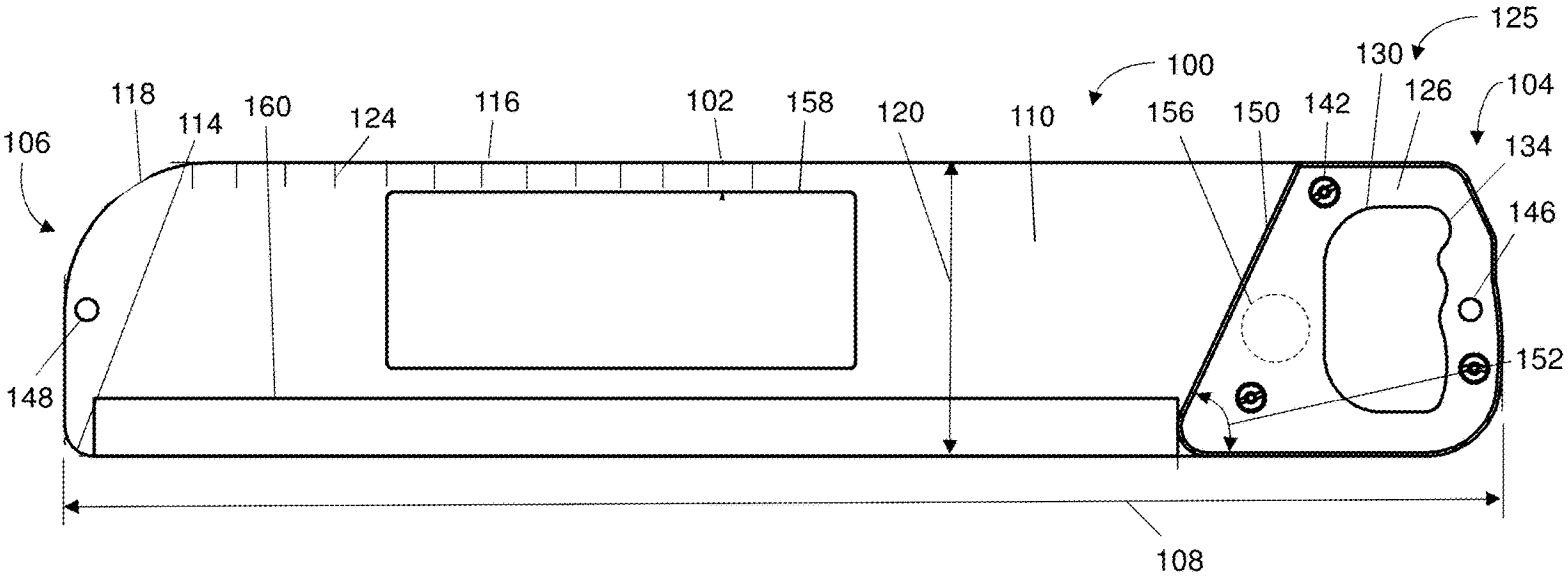
FIG. 3 is a side view of an exemplary item alignment tool of the present disclosure.
Figure 4:
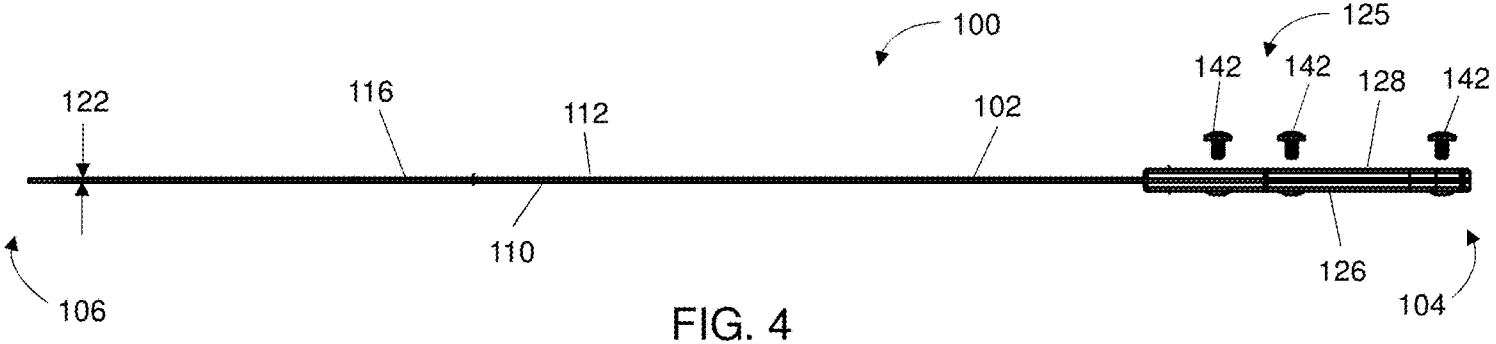
FIG. 4 is a top view of an exemplary item alignment tool of the present disclosure.

In some embodiments, the height 120 can vary between points near the proximal and distal ends 104, 106, with the bottom edge 114 maintaining a substantially parallel orientation relative to the horizontal x-axis and the top edge 116 being angled relative to the bottom edge 114. As shown in FIGS. 1 and 2, the x-axis, y-axis and z-axis can be substantially perpendicular to each other. In some embodiments, the top edge 116 of the body 102 can include graduations 124 formed therein or glued over the top edge 116. The graduations 124 can be used as a source of measuring distances relative to the distal end 106. For example, when the tool 100 is inserted between items on a shelf, the graduations 124 can be used to measure the depth of extension of the distal end 106 of the tool 100 into the shelf.

The tool 100 includes a handle 125 coupled to the proximal end 104 of the body 102. In some embodiments, the handle 125 can be in the form of a single piece construction with a slot that receives the proximal end 104 of the body 102. In the embodiment of FIGS. 1-4, the handle 125 can be in the form of first and second handle halves 126, 128 coupled to the opposing side walls 112, 112 of the body 102. Each handle half 126, 128 includes a cutout or opening 130 extending therethrough. The body 102 also includes a cutout or opening 132 extending therethrough, with the openings 130, 132 being complementary and substantially aligned when the handle halves 126, 128 are assembled with the body 102. The openings 130, 132 define a passage through which a hand of a user can pass to grip the handle.

The openings 130, 132 can include curved or linear portions, and an ergonomically formed section 134, 136. The ergonomically formed section 134, 136 can include peaks and valleys configured to receive the individual fingers of the user, thereby providing a more comfortable gripping section of the tool 100. In some embodiments, the ergonomically formed section 134, 136 configured for gripping of the tool 100 can be substantially perpendicular to the bottom edge 114 and substantially parallel to the distal edge of the tool 100. The ergonomically formed section 134, 136 can also be substantially parallel to the opposing wall defining the openings 130, 132. The body 102 includes two or more holes 138 formed around the opening 132, and the handle halves 126, 128 include two or more holes 140 configured to align with the holes 138 of the body 102. The holes 138, 140 can receive fasteners 142 (e.g., screws, bolts, rivets, or the like) to maintain the handle halves 126, 128 coupled to the body 102.

In some embodiments, the proximal end 104 of the body 102 and the proximal end of the handle halves 126, 128 can include a complementary hole 144, 146. The holes 144, 146 align when the handle halves 126, 128 are coupled to the body 102 such that the tool 100 can be hung on, e.g., a nail, for storage. In some embodiments, the distal end 106 of the body 102 can include a hole 148 formed therein for hanging the tool 100 for storage. In some embodiments, the handle 125 can include one or more illumination sources 154 (e.g., a light emitting diode, a laser beam, or the like) coupled thereto, allowing the user to illuminate the shelf during use of the tool 100. In such embodiments, the illumination source 154 can be used to assist in visual ability to, e.g., ensure that the correct items are being engaged with the tool 100, inspect the shelf for visible signs of damage, inspect the shelf and/or items for housekeeping issues, or the like. In some embodiments, the illumination source 154 can be used to ensure that the tool 100 is perpendicularly positioned relative to the front edge of the shelf based on the height of the illumination point at the rear of the shelf. The illumination source 154 can be selectively actuated between an on and off position. In some embodiments, the illumination source 154 can be coupled to the distal end 106 of the body 102. In some embodiments, the handle 125 can include a magnet 156 for detachably coupling the tool 100 to a metal surface (e.g., the shelf) for storage.

In some embodiments, the proximal edge of the handle 125 can be substantially perpendicular to the bottom edge 114 of the body 102. In some embodiments, the distal edge 150 of the handle 125 can be substantially perpendicular to the bottom edge 114 of the body 102. In some embodiments, the distal edge 150 of the handle 125 can extend at an angle 152 relative to the bottom edge 114 of the body 102. In some embodiments, the angle 152 can be an acute angle. The acute angle 152 of the distal edge 150 reduces the overall surface area of the handle 125 and creates a greater exposed surface area of the side walls 110, 112 available for aligning items on the shelf.

The tool 100 includes a wrap 160 positioned over and covering at least a portion of the bottom edge 114 of the body 102. In some embodiments, the wrap 160 can be formed from a vinyl material, a silicone material, a dipped ceramic, a high-density polyethylene, or the like, and provides a cushion or protective layer for the tool 100 and the shelf surface along which the tool 100 is moved. The wrap 160 is generally formed from a softer material than the body 102. In some embodiments, the wrap 160 can assist in reducing the coefficient of friction for sliding the tool 100 along the shelf surface (e.g., the coefficient of friction of the wrap 160 is less than the coefficient of friction of the body 102) and for protecting a surface of the shelf from body 102. Particularly, the wrap 160 encourages a reduction in friction during use of the tool 100 such that the tool 100 can be removed from between closely indexed items with little effort and without causing the items to be moved with the force of removal of the tool 100. The items aligned using the tool 100 therefore remain substantially unmoved during removal of the tool 100 from between the items.

The wrap 160 generally extends over only a portion of the length 108 of the body 102 (e.g., between a point at or near the distal end 106 and the handle 125). The wrap 160 generally extends over only a portion of the height 120 of the side walls 110, 112. The wrap 160 therefore covers a portion of the bottom edge 114 between the distal end 106 and the handle 125, and secures to the side walls 110, 112. For example, if the length 108 is approximately 24.5 inches, the length of the wrap 160 can be approximately 19 inches. In some embodiments, the wrap 160 can extend to cover the bottom edge of the handle 125 (and the bottom edge 114 of the body 102 at the proximal end 104). In exemplary embodiments, the wrap 160 can be affixed or secured to the body using an adhesive or other binding material(s) that prevent removal of the wrap 160 from the body 102 in the course of ordinary use.

Figure 5:
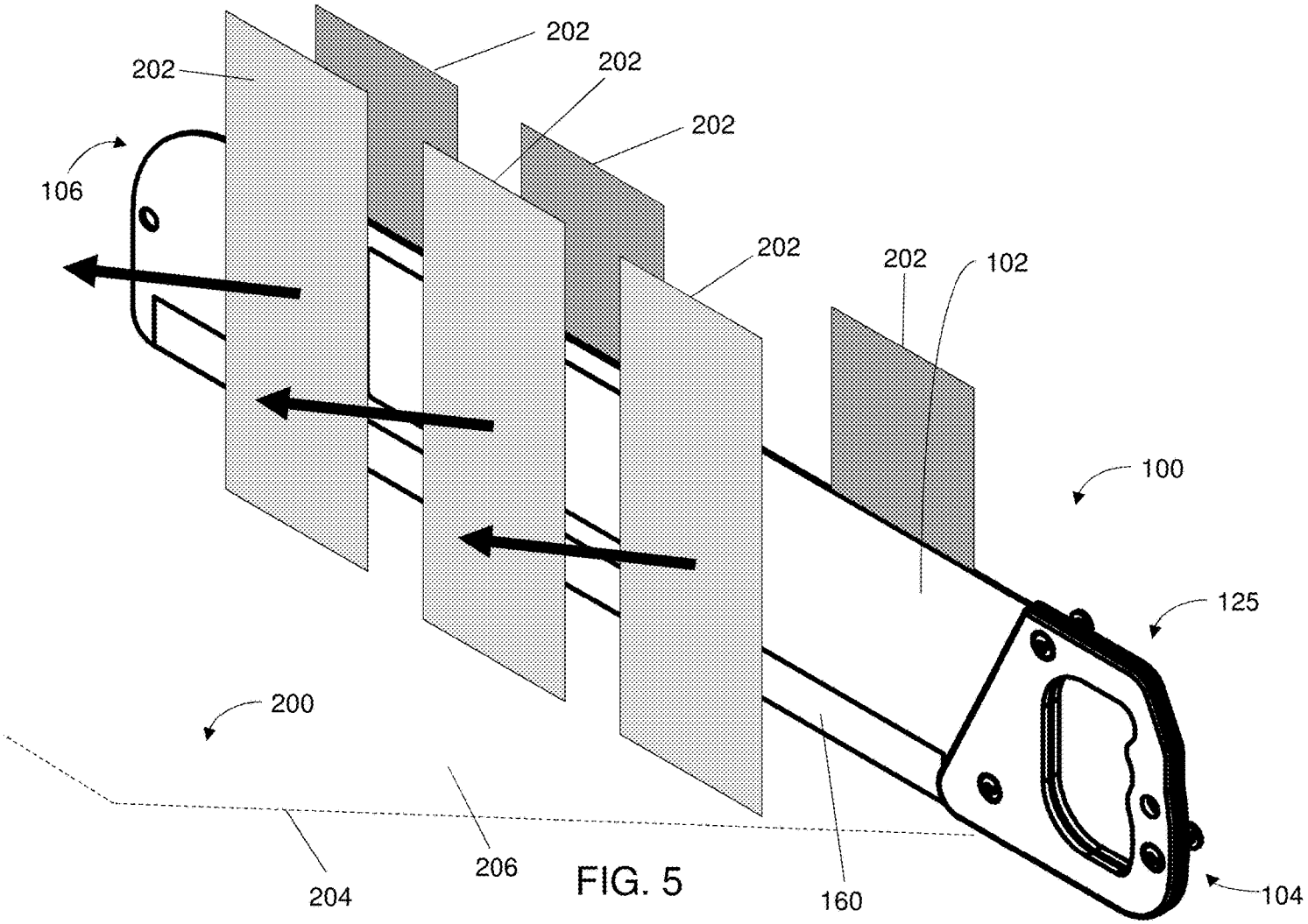
FIG. 5 is a diagrammatic view of an exemplary item alignment tool of the present disclosure aligning items on a shelf.

FIG. 5 is a diagrammatic view of the tool 100 being used to align items 202 on a shelf 200. The shelf 200 generally includes a front edge 204 and a substantially flat top surface 206 on which items 202 are positioned for display to customers. The planar shape of the elongated body 102 allows the tool 100 to be passed between adjacently positioned items 202 in the direction of the deepest part of the shelf 200 without having to pass the user's hands between the items 202.

With the bottom edge 114 (e.g., the wrap 160) positioned against the top surface 206 of the shelf 200 and the body 102 disposed between the items 202, lateral movement of the tool 100 urges the items 202 to the left or right, depending on the direction of alignment. For example, FIG. 5 shows alignment of the items 202 in the leftward direction. The rigidity of the body 102 allows for multiple items 202 to be simultaneously aligned, providing zoning efficiency and ensuring that the items 202 are aligned along the same plane relative to the front edge 204 of the shelf 200.

Figure 6:
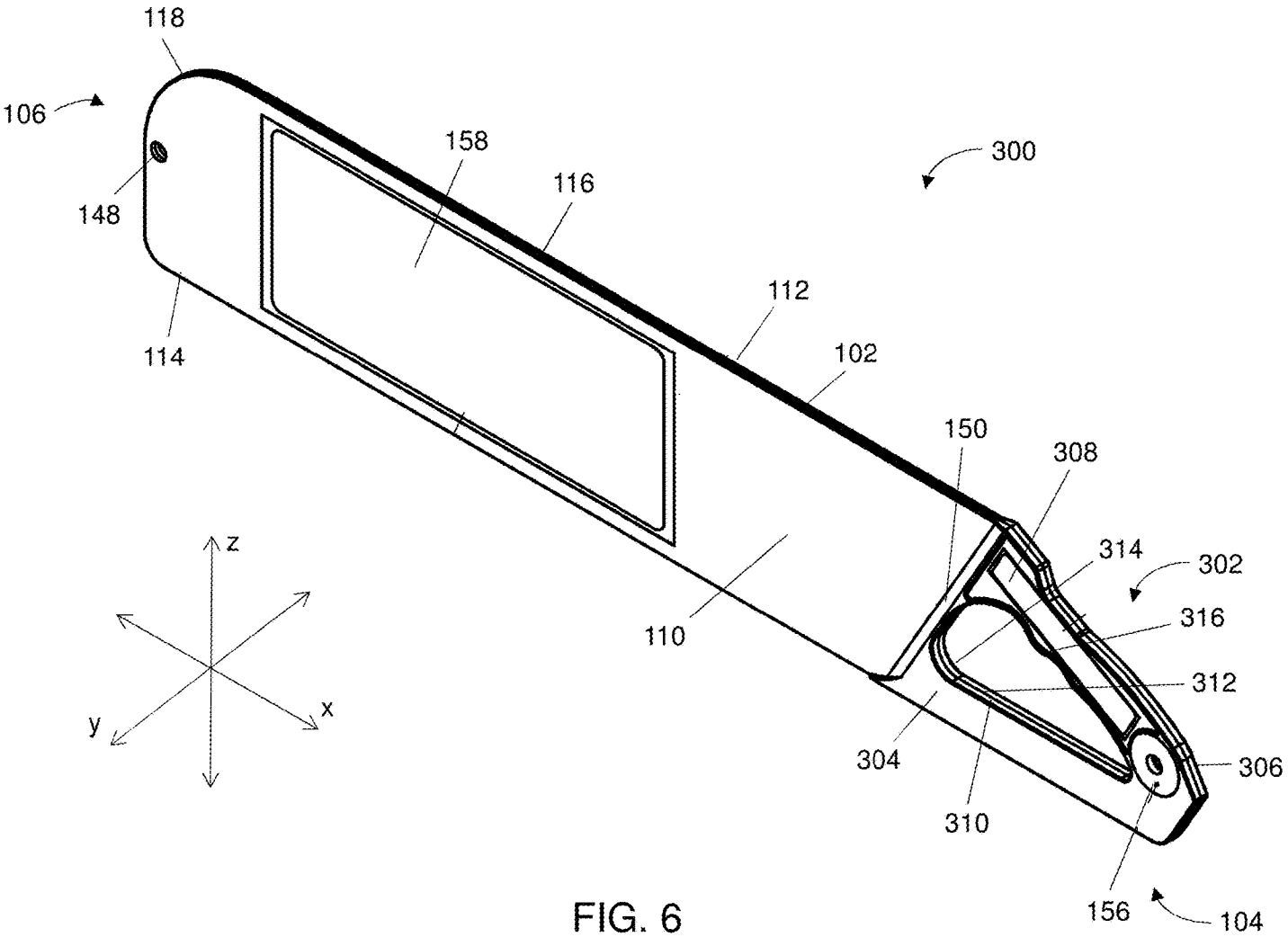
FIG. 6 is a perspective view of an exemplary item alignment tool of the present disclosure.
Figure 7:
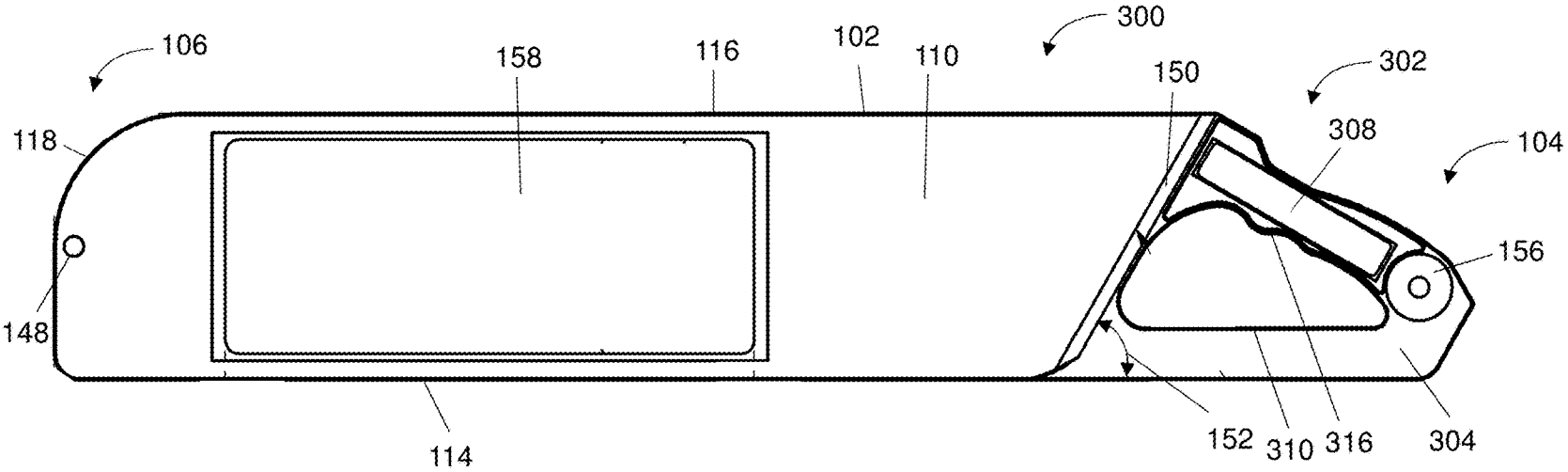
FIG. 7 is a side view of an exemplary item alignment tool of the present disclosure.
Figure 8:
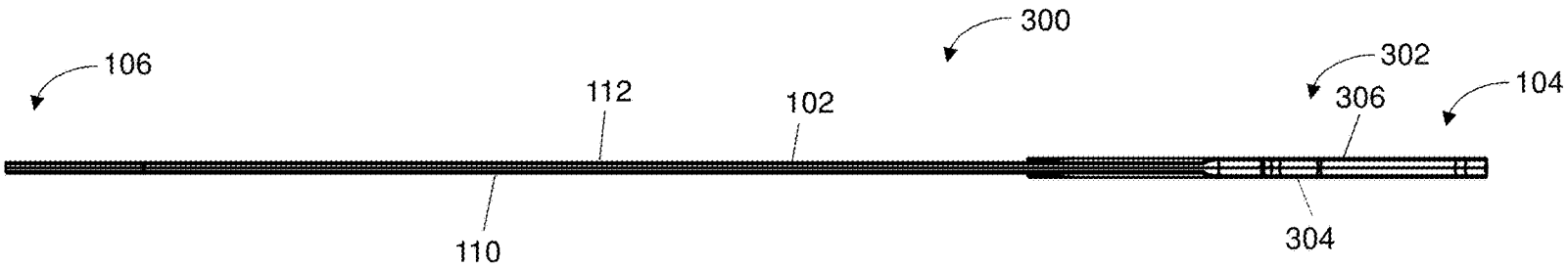
FIG. 8 is a top view of an exemplary item alignment tool of the present disclosure.

FIGS. 6-8 are perspective, side and top views of an exemplary item alignment tool 300 (hereinafter "tool 300"). The tool 300 can be substantially similar in structure and function to the tool 100, except for the distinctions noted herein. Therefore, like reference numbers refer to like structures. In particular, the tool 300 also includes a handle 302 with first and second handle halves 304, 306 coupled to the proximal end 104 of the body 102. The distal edge 150 of the handle 302 can taper from the handle 302 to the body 102, thereby creating a smooth, angled transition to the body 102.

The handle 302 can include a label 308 adhered to one or both sides of the handle 302. The handle 302 and the body 102 include complementary cutouts or openings 310, 312, 314 extending therethrough and configured to receive the hand of the user gripping the tool 300. The openings 310, 312, 314 also include an ergonomically formed section 316 configured to mate with the fingers of the user. In some embodiments, the ergonomically formed section 316 can be oriented at an angle to the bottom edge 114, the bottommost wall of the openings 310, 312, 314, and the distal edge of the tool 300. In particular, rather than being perpendicular to the bottom edge 114 and substantially parallel to the distal edge of the tool 300 (see, e.g., the ergonomically formed section 134 of the tool 100), the ergonomically formed section 316 can be angled towards the distal end 106 by an obtuse angle (e.g., approximately 120°, approximately 125°, approximately 130°, approximately 135°, approximately 140°, approximately 145°, or the like). In some embodiments, the bottommost wall of the openings 310, 312, 314 can be substantially parallel to the bottom edge 114 of the body 102.

Thus, while the tool 100 is configured to be gripped at the proximal end of the handle 125, the tool 300 is configured to be gripped at an upper edge of the handle 302 offset from the proximal end 104 of the tool 300. The different gripping position for the tool 300 can assist in imparting a downward force on the tool 300 to maintain the bottom edge 114 against the top surface of the shelf. Although illustrated without the wrap 160, it should be understood that the wrap 160 can be coupled to the bottom edge 114 of the tool 300. In some embodiments, an illumination source 154 can also be incorporated into the handle 302.

Figure 9:
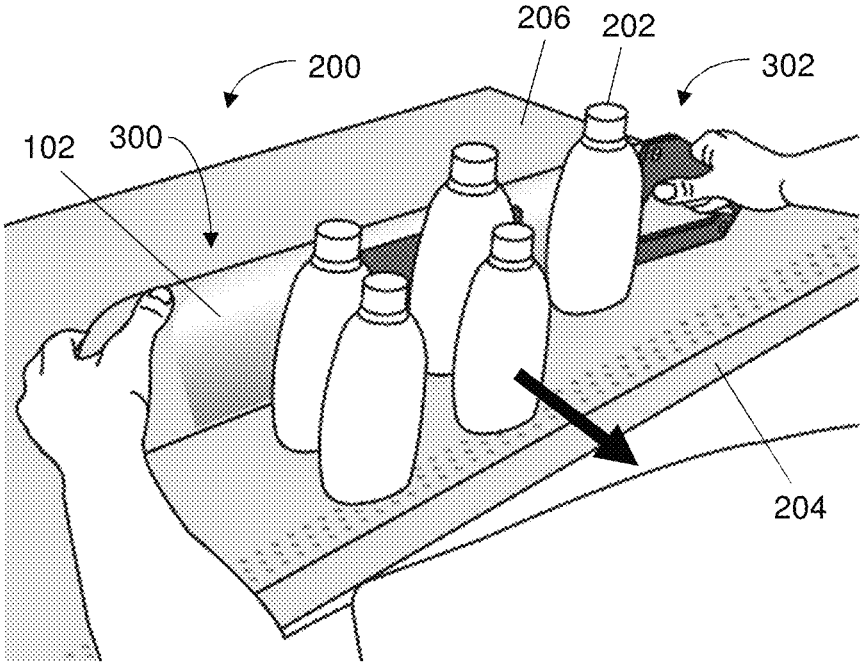
FIG. 9 is a diagrammatic view of an exemplary item alignment tool of the present disclosure aligning items with a front edge of a shelf.
Figure 10:
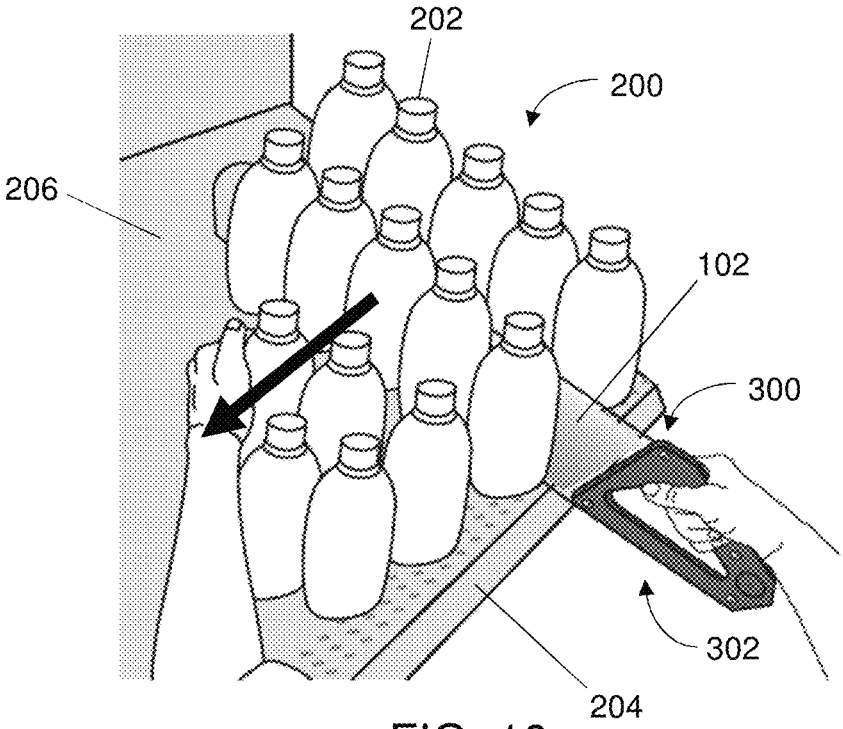
FIG. 10 is a diagrammatic view of an exemplary item alignment tool of the present disclosure straightening items on a shelf.

FIGS. 9-10 are a diagrammatic views of the tool 300 being used to align items 202 on a shelf 200. In some embodiments, as shown in FIG. 9, the tool 300 can be used to move and align the items 202 with the front edge 204 of the shelf 200. In some embodiments, such alignment can be performed by only holding the tool 300 at the handle 302. In some embodiments, the tool 300 can be grasped at the handle 302 and the opposing end (as shown in FIG. 9) to slide the items 202 to the front edge 204 of the shelf 200.

Figure 11:
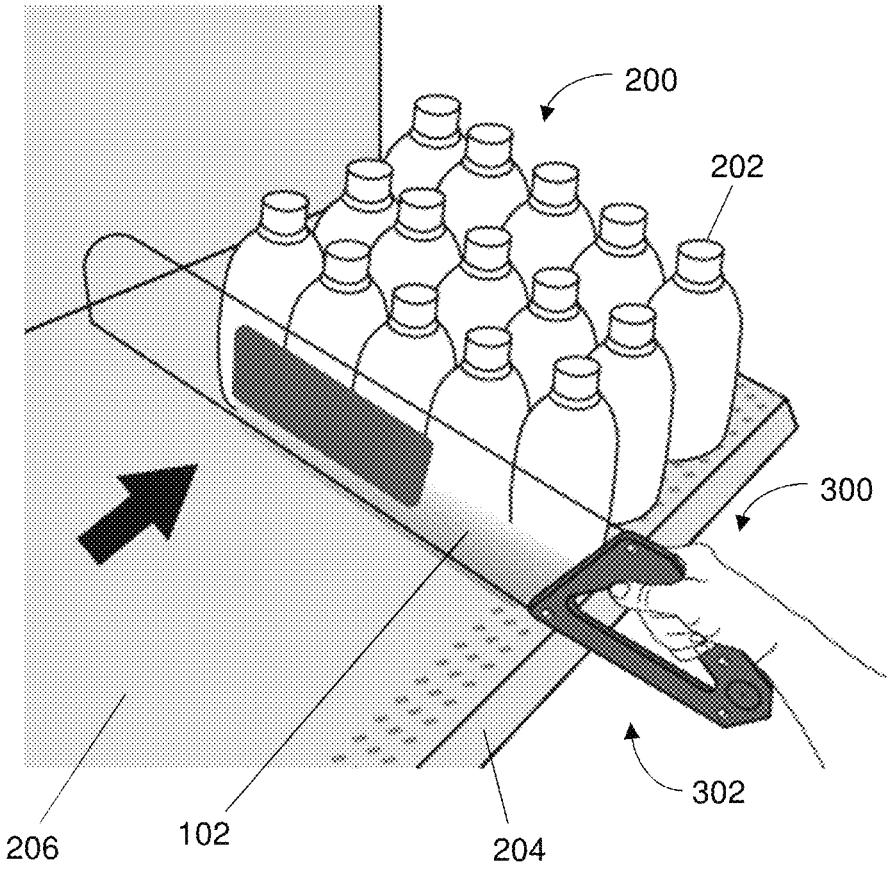
FIG. 11 is a diagrammatic view of an exemplary item alignment tool of the present disclosure aligning items on a shelf.

As shown in FIG. 10, the tool 300 can be used to straighten the items 202 be laterally moving the tool 300 across the top surface 206 of the shelf 200. In some embodiments, the tool 300 can be used to maintain the position of the items 202 and a user's hand can be used to push and slide the items 202 in the direction of the tool 300, thereby straightening and aligning the items 202 with the tool 300. As shown in FIG. 11, the tool 300 can be laterally moved across the top surface 206 of the shelf 200 to slide and align the items 202 with a particular position on the shelf 200. Thus, the tool 300 can be used in a variety of ways for zoning items 202 on the shelf 200.

The exemplary alignment tools therefore provide for an efficient means for reaching between multiple items disposed on a shelf without disturbing the surrounding items. The rigid elongated body of the exemplary alignment tools further allows for simultaneously aligning multiple items, with the rigidity of the body ensuring accurate alignment each time. Particularly, rather than flexing under the resistance from the items when laterally moving the alignment tool, the rigid body withstands the lateral forces to efficiently and effectively align multiple items along the shelf surface.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. An item alignment tool for aligning items on a shelf, comprising:

an elongated planar body defining a proximal end, a distal end, a bottom straight edge, a top edge, and first and second opposing sides extending between the bottom straight edge and the top edge, the proximal and distal ends of the elongated planar body defining opposing endpoints of the item alignment tool;

a handle coupled to the proximal end of the elongated planar body; and a wrap permanently secured to the elongated planar body, the wrap positioned over and covering at least a portion of the bottom straight edge of the elongated planar body to provide a protective layer for sliding along a surface of a shelf to facilitate alignment of items on the shelf, wherein:

the wrap extends over at least a portion of the first and second opposing sides of the elongated planar body;

the handle comprises a first handle half and a second handle half coupled on opposing sides of the elongated planar body; or the wrap is permanently secured to the elongated planar body with adhesive to prevent removal of the wrap from the elongated planar body.

2. The item alignment tool of claim 1, wherein the bottom straight edge is uniformly flat between a point near the proximal end of the elongated planar body and a point near the distal end of the elongated planar body.

3. The item alignment tool of claim 1, wherein the proximal end of the elongated planar body includes a cutout extending therethrough defining a passage configured to receive a hand of a user during gripping of the handle.

4. The item alignment tool of claim 3, wherein the handle includes an opening extending therethrough, the opening in the handle further defining the passage configured to receive the hand of the user during gripping of the handle.

5. The item alignment tool of claim 4, wherein the opening of the handle is complementary to the cutout of the elongated planar body.

6. The item alignment tool of claim 1, wherein the handle comprises a distal edge extending at an angle relative to the bottom edge of the elongated planar body.

7. The item alignment tool of claim 6, wherein the angle is an acute angle.

8. The item alignment tool of claim 1, wherein the elongated planar body defines a rigid structure.

9. The item alignment tool of claim 1, wherein the bottom straight edge and the top edge of the elongated planar body define planar or linear surfaces.

10. The item alignment tool of claim 1, wherein a distance between the bottom straight edge and the top edge is equal between a point near the proximal end of the elongated planar body and a point near the distal end of the elongated planar body.

11. The item alignment tool of claim 1, comprising a magnet incorporated into the handle.

12. The item alignment tool of claim 1, comprising an illumination source incorporated into the handle.

13. The item alignment tool of claim 1, wherein the top edge of the elongated planar body comprises graduations for distance measurement.

14. The item alignment tool of claim 1, comprising a label attached to at least one of the first or second side of the elongated planar body.

15. The item alignment tool of claim 1, wherein one or more corners at the distal end of the elongated planar body are curved.

16. An item alignment tool for aligning items on a shelf, comprising:

an elongated planar body defining a proximal end, a distal end, a bottom straight edge, a top edge, and first and second opposing sides extending between the bottom straight edge and the top edge, the bottom straight edge and the top edge of the elongated planar body defining planar or linear surfaces, the proximal and distal ends of the elongated planar body defining opposing endpoints of the item alignment tool;

a handle coupled to the proximal end of the elongated planar body; and a wrap positioned over and covering at least a portion of the bottom straight edge of the elongated planar body, the wrap being fixedly and permanently attached to the portion of the bottom straight edge, and the wrap providing a protective layer for sliding along a surface of a shelf to facilitate alignment of items on the shelf;

wherein:

the wrap extends over at least a portion of the first and second opposing sides of the elongated planar body;

the handle comprises a first handle half and a second handle half coupled on opposing sides of the elongated planar body; or the wrap is permanently attached to the portion of the bottom straight edge of the elongated planar body with adhesive to prevent removal of the wrap from the elongated planar body.

17. A method of aligning items on a shelf having a supporting surface, comprising:

positioning an item alignment tool on the supporting surface of the shelf, the item alignment tool including (i) an elongated planar body defining a proximal end, a distal end, a bottom straight edge, a top edge, and first and second opposing sides extending between the bottom straight edge and the top edge, (ii) a handle coupled to the proximal end of the elongated planar body, and (iii) a wrap permanently secured to the elongated planar body, the wrap positioned over and covering at least a portion of the bottom straight edge of the elongated planar body;

extending the distal end of the elongated planar body between items on the supporting surface of the shelf; and laterally sliding the elongated planar body along the supporting surface to urge the items towards a specific side of the shelf.

18. An item alignment tool for aligning items on a shelf, comprising:

an elongated planar body defining a proximal end, a distal end, a bottom straight edge, a top edge, and first and second opposing sides extending between the bottom straight edge and the top edge, the proximal and distal ends of the elongated planar body defining opposing endpoints of the item alignment tool;

a handle coupled to the proximal end of the elongated planar body; and a wrap permanently secured to the elongated planar body, the wrap positioned over and covering at least a portion of the bottom straight edge of the elongated planar body to provide a protective layer for sliding along a surface of a shelf to facilitate alignment of items on the shelf, wherein the proximal end of the elongated planar body includes a cutout extending therethrough defining a passage configured to receive a hand of a user during gripping of the handle.

19. The item alignment tool of claim 18, wherein the handle includes an opening extending therethrough, the opening in the handle further defining the passage configured to receive the hand of the user during gripping of the handle.

20. The item alignment tool of claim 19, wherein the opening of the handle is complementary to the cutout of the elongated planar body.

* * * * *